US007010138B1

(12) United States Patent
Harris et al.

(10) Patent No.: US 7,010,138 B1
(45) Date of Patent: Mar. 7, 2006

(54) LOUDSPEAKERS

(75) Inventors: Neil Harris, Cambridge (GB); Graham Bank, Cambridgeshire (GB)

(73) Assignee: New Transducers Limited, Huntingdon (GB)

( * ) Notice: Subject to any disclaimer, the term of this patent is extended or adjusted under 35 U.S.C. 154(b) by 0 days.

(21) Appl. No.: 09/435,354

(22) Filed: Nov. 8, 1999

Related U.S. Application Data

(63) Continuation-in-part of application No. 08/707,012, filed on Sep. 3, 1996.

(60) Provisional application No. 60/150,817, filed on Aug. 26, 1999, provisional application No. 60/150,824, filed on Aug. 26, 1999.

(30) Foreign Application Priority Data

Nov. 6, 1998 (GB) ..... 9824255
Jun. 22, 1999 (GB) ..... 9914410

(51) Int. Cl.
*H04R 25/00* (2006.01)

(52) U.S. Cl. ..... 381/337; 381/152; 381/338; 381/339; 381/340

(58) Field of Classification Search ..... 381/306, 381/302, 333, 334, 335, 152, 337, 338–342, 381/343, 349, 350, 160, 190, 431, 352; 181/189, 181/196, 22, 152, 155, 156, 159, 175–177
See application file for complete search history.

(56) References Cited

U.S. PATENT DOCUMENTS

| | | | | | |
|---|---|---|---|---|---|
| 1,246,317 | A | * | 11/1917 | Porter | 181/177 |
| 2,956,636 | A | | 10/1960 | Boersma | 181/31 |
| 3,509,282 | A | * | 4/1970 | Ashworth | 381/152 |
| 4,811,406 | A | * | 3/1989 | Kawachi | 381/182 |
| 5,394,478 | A | * | 2/1995 | Hathaway et al. | 381/345 |
| 5,524,062 | A | * | 6/1996 | Oh | 381/338 |
| 5,737,435 | A | * | 4/1998 | De Poortere et al. | 381/340 |
| 5,751,827 | A | * | 5/1998 | Takahashi | 381/190 |
| 6,351,542 | B1 | * | 2/2002 | Azima | 381/431 |

FOREIGN PATENT DOCUMENTS

| | | |
|---|---|---|
| EP | 0 353 092 | 1/1990 |
| WO | WO 97/09842 | 3/1997 |
| WO | WO 98/43464 | 10/1998 |

* cited by examiner

*Primary Examiner*—Suhan Ni
(74) *Attorney, Agent, or Firm*—Foley & Lardner LLP

(57) ABSTRACT

A loudspeaker comprising a phase uncorrelated diffuse sound source and a duct or wave guide coupled to the sound source to direct acoustic energy from the source, the duct or wave guide having a substantially parallel section extending from the vicinity of the sound source and a termination positioned remotely from the panel.

27 Claims, 7 Drawing Sheets

Figure 10a
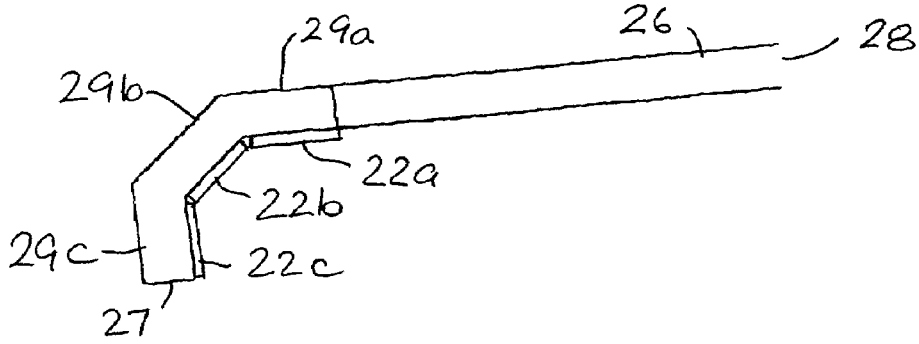
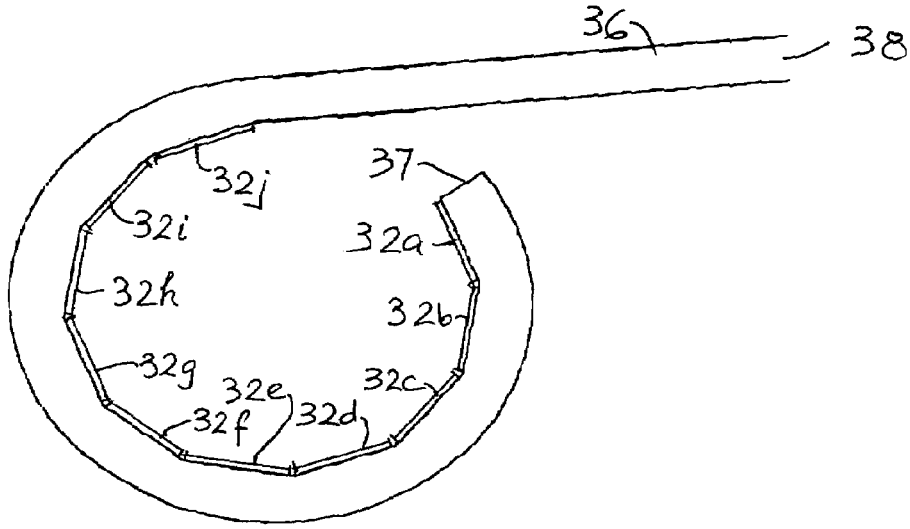
Figure 10b

LOUDSPEAKERS

This application is a continuation-in-part of application Ser. No. 08/707,012, filed Sep. 3, 1996. This application also claims the benefit of provisional application No. 60/150,817, filed Aug. 26, 1999, and provisional application No. 60/150,824, filed Aug. 26, 1999. The disclosures of all three of these applications are incorporated herein by reference.

DESCRIPTION

Technical Field

The invention relates to loudspeakers.

It is an object of the invention to provide means whereby sound from a loudspeaker can be channelled to one or more remote locations.

BACKGROUND ART

It is known from WO98/43464 of New Transducers Limited to provide a personal computing device of the kind having a body comprising a keyboard and a lid hinged to the body and comprising a display screen, characterised by a resonant panel loudspeaker in or attached to the lid and an acoustic waveguide or horn directing acoustic output from the loudspeaker in a desired direction.

DISCLOSURE OF INVENTION

According to the invention, there is provided a loudspeaker comprising a phase uncorrelated diffuse sound source and a duct or wave guide coupled to the sound source to direct acoustic energy from the source, the duct or wave guide having a substantially parallel section extending from the vicinity of the sound source and a termination positioned remotely from the source.

The sound source may comprise a bending wave mode acoustic radiator panel. A transducer may be fixed to the panel to excite resonant bending waves therein, the resonant bending wave modes associated with each of the axes of the panel being arranged to be interleaved in frequency and the transducer location being chosen preferentially to couple to the resonant bending wave modes.

The duct may be shaped as a narrow slot in cross-section, or may be of any other desired cross-sectional shape.

The duct may be terminated by a horn section.

The panel may be located in the duct to couple acoustic radiation from both sides of the panel.

An acoustic reflector may be coupled to the duct and to the sound source to direct acoustic radiation into the duct.

The duct may have a plurality of terminations and these may be spaced along the duct.

A plurality of the panels may be coupled to the duct.

The duct may be folded.

The loudspeaker may comprise an attenuator controlling sound output from a duct termination.

Means may be provided for subdividing the duct into a plurality of wave guides extending along the duct. The duct may be subdivided in two directions, i.e. laterally and vertically.

An acoustic reflector may be disposed to direct the acoustic output from a duct termination.

Enclosure means may enclose one face of the panel.

The plane of the panel may be parallel to the axis of the duct.

Although the invention has been described in terms of a loudspeaker, it will be appreciated that it may find other applications, e.g. as a microphone or as an acoustic absorber, whether passive or active.

BRIEF DESCRIPTION OF DRAWINGS

The invention is diagrammatically illustrated, by way of example, in the accompanying drawings in which:—

FIG. 10*a* is a schematic side view of an eighth embodiment of loudspeaker of the invention;

FIG. 10*b* is a schematic side view of a ninth embodiment of loudspeaker of the invention;

BEST MODES FOR CARRYING OUT THE INVENTION

Figure 1:
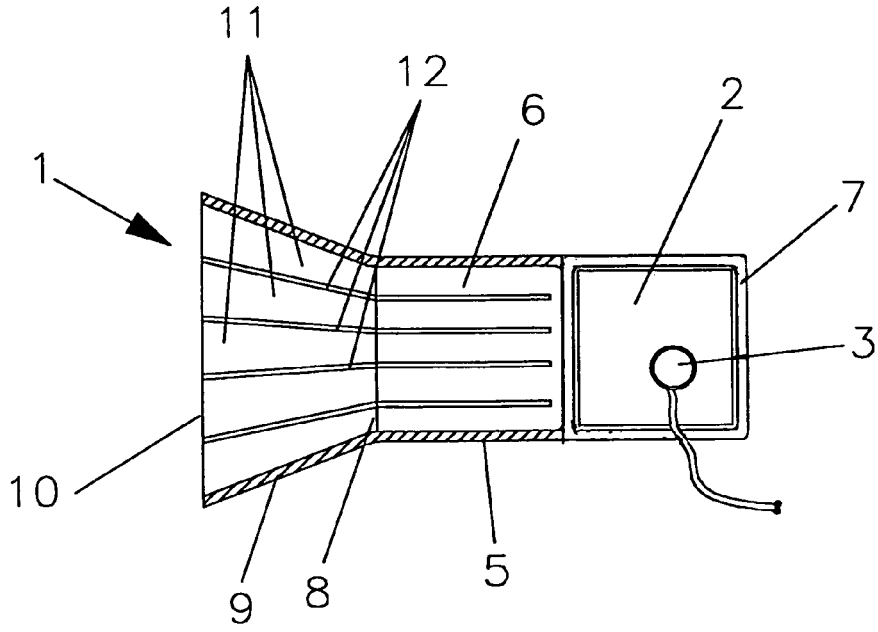
FIG. 1 is a front partial cross-sectional view of a first embodiment of loudspeaker of the invention.

The invention relies on largely phase uncorrelated, diffuse radiation properties of a sound source or generator e.g. a flat resonant bending wave panel, for example of the kind described in parent application Ser. No. 08/707,012 (and in counterpart publication WO97/09842) to allow coupling to an acoustic fluid, normally air, contained in a shallow volume well coupled to the source of sound energy. In contrast to the coupling aspects of correlated e.g. pistonic devices which suffer problems due to path length differences, phase cancellations and subsequent power irregularities, a diffuse source allows for good integration of acoustic power over its radiating surface and that power may be conducted via fluid coupling to a remote point via a duct. Modal resonances which are normally severe in such a duct are mitigated due to the diffuse uncorrelated nature of the acoustic energy entering the duct.

The duct termination may radiate directly, which if in the form of a narrow slot or similar aperture has wide directivity and is not frequency controlling or frequency selective. If modified directive properties are required then various sizes shapes and combinations of acoustic horn known to the art may be added to the open end of the duct.

The principle of diffuse coupling may extend to simple single reflective elements acting as vestigial horns or part ducts, and the length of the duct may be varied to a point where the horn section is almost directly presented to the diffuse source.

A notable feature of the invention is that the duct can be presented in the plane of the radiator and achieve effective action. Also the sound energy on the surface of the source can be divided and directed down more than one duct or wave guide, and these may be of unequal lengths and if required the several outputs recombined smoothly after passage down the ducts wave guides.

Twin ducts may be used to utilise the energy from both sides of the diffuse source. The preferred source is one or more bending wave panels but other such sources include an array of small conventional pistonic speakers fed phase randomised signals or an array of digital speaker elements driven by signals suitably processed to provide a diffuse acoustic function. The duct provides a beneficial integrating function which may be designed as a low pass acoustic filter to complete the desired response from an array element digital speaker.

The twin ducts may be laterally disposed to provide sound at two separated locations e.g. across the passenger compartment of a vehicle benefiting from a single centrally or near centrally located sound generator.

The duct may be straight, curved or folded to allow a slim assembly to be fitted into difficult locations where conventional speaker could not be placed.

Wide range sound may ducted to substantially small radiating apertures, for example the slots (normally disguised behind an acoustically transparent grille) at the sides of a television monitor. Duct performance may be further enhanced by cellular subdivision to inhibit cross standing waves.

The duct and/or horn has a low frequency loading function which may be simply calculated using lumped parameters. This may beneficially load the sound source to enhance the low range performance by added/matched air mass and by a baffle effect due to extended path length between the front and rear of the sound generators where relevant.

The rear of the panel or multiple panel (with same or frequency selective/differential area drive/form) or multiple cone type sound generators may have a partially or wholly enclosed rear chamber(s) for additional resonant enhancement and control of the low frequency acoustic path between front and rear.

Duct height and/or cross sectional area is influential in determining the higher frequency point for smooth transmission of sound energy. Thus a rectangular duct of 30 mm height will show some frequency dependency above 10 kHz, whereas a 10 mm section will perform well to beyond 25 kHz.

In addition to lateral subdivisions of the duct, the sub division of the duct may be extended to the vertical direction to subdivide the duct still further for maintained transmission performance at higher frequencies.

The exit area of duct driven by a diffuse source has an influence on loudness and relative to the intrinsic area of the exit a variable area mechanism such as a movable blanking plate over the duct termination may provide a convenient and effective form of loudness control without a significant loss in sound quality. A horn directive element may be applied after the mechanical loudness control device. Thus a user volume control may be remote from the sound generator. Alternatively a duct control device may be provided at any convenient location along the duct.

A horn termination is driven well by the duct of the invention, and the horn can provide an effective and calculable control of directivity for a diffuse source. The duct termination alone provides uniform wide angle radiation, an almost perfect slot or near point source.

In respect of coincidence effects which may result in off axis lobes of power at discrete frequencies for particular designs of bending wave panel, the fluid coupling and duct integration action reconfigures the sound energy such that the directive effects of coincidence are no longer a feature of the resultant acoustic output.

The duct can be any length, and terminations may be provided along the length of the duct to give a simple distributed low level sound system. Multiple resonant panels could feed a duct, and a multiple panel arrangement could be made more compact by folding or bending the region in front of the panel, before the duct.

Figure 2:
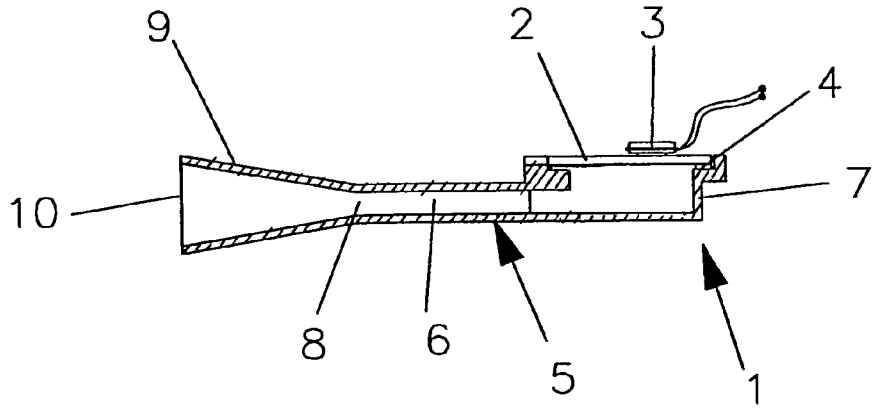
FIG. 2 is a cross-sectional side view of the loudspeaker of FIG. 1.

In the drawings, and referring to FIGS. 1 and 2 there is shown a loudspeaker 1 comprising a resonant bending-wave panel 2 generally of the kind described in parent application Ser. No. 08/707,012 (and in WO97/09842), which is driven by a vibration exciter 3 fed with an electrical audio signal from a suitable audio amplifier (not shown). The panel 2 is resiliently mounted by its edges on a resilient suspension 4 in a housing 5 in the form of a parallel sided shallow slot-like duct 6 having a closed end 7 and an open end 8 which opens into a flared horn section 9 which ends at opening or termination 10. The housing may be made from any suitable non resonant material such as those materials from which loudspeaker enclosures are normally constructed, e.g. medium density fibreboard or plastics. Alternatively, at least the duct may be made of a flexible material, provided that it is suitably dense so as to be substantially non resonant in the frequency range of its intended use. Thus the duct may be in the form of a flexible pipe, e.g. of high density polyethylene or the like.

The duct and horn sections are subdivided into wave guides 11 by dividers 12 extending along the duct and horn sections.

Figure 3:
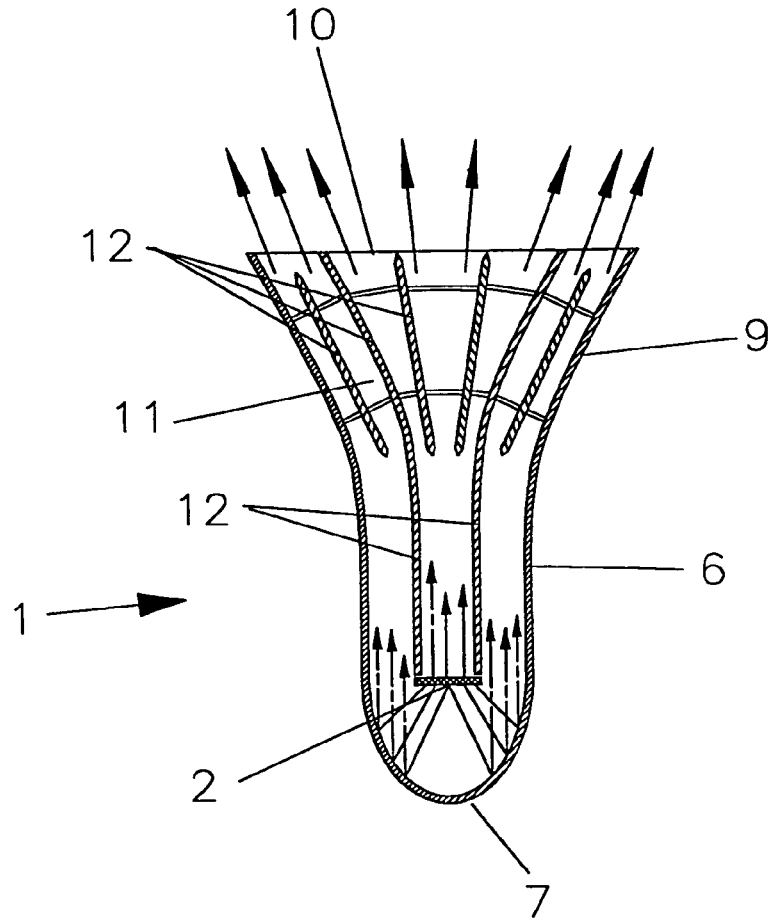
FIG. 3 is a front cross-sectional view of a second embodiment of loudspeaker of the invention.

FIG. 3 shows an embodiment of a loudspeaker very similar to that of FIGS. 1 and 2. In this case, however, the inner or closed end 7 of the duct 6 is formed as a curved, e.g. parabolic, reflector to reflect acoustic radiation from the panel 2 towards the open end of the duct. Also in this embodiment, the plane of the panel 2 is set at right angles to the direction of the duct whereas in FIGS. 1 and 2 the plane of the panel is disposed in the direction of the duct. Furthermore in this embodiment the horn section is outwardly flared or curved, whereas in the embodiment of FIGS. 1 and 2, the horn section is conical.

Figure 4:
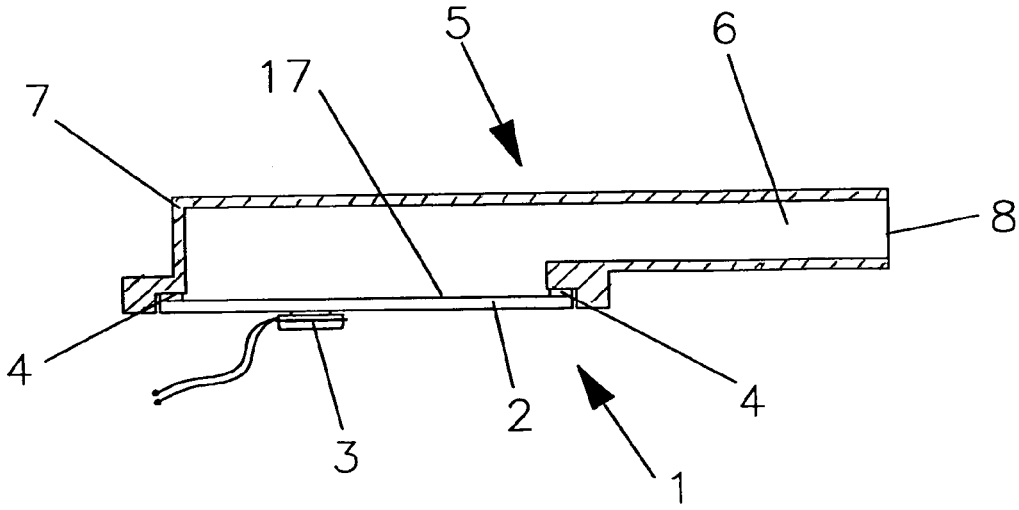
FIG. 4 is a cross-sectional side view of a third embodiment of loudspeaker of the invention.

FIG. 4 shows a loudspeaker arrangement generally as shown in FIGS. 1 and 2 above and in which a housing 5 defining a parallel sided duct 6 has an open end 8 which terminates the duct, and a closed end 7. The housing supports a resonant bending-wave panel 2 on a resilient suspension 4 so that acoustic radiation from one face 17 of the panel facing into the housing 5 is directed along the duct to a remote location wherein the sound radiation is emitted from the open end of the duct.

Figure 5:
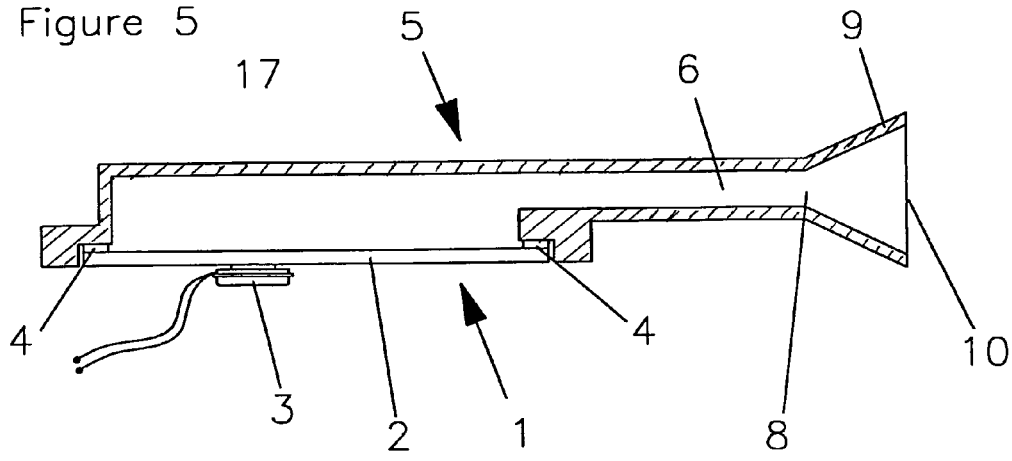
FIG. 5 is a cross-sectional side view of a fourth embodiment of loudspeaker of the invention.

The loudspeaker shown in FIG. 5 is the same as that shown in FIG. 4 except that the duct is terminated by a horn 9.

Figure 6:
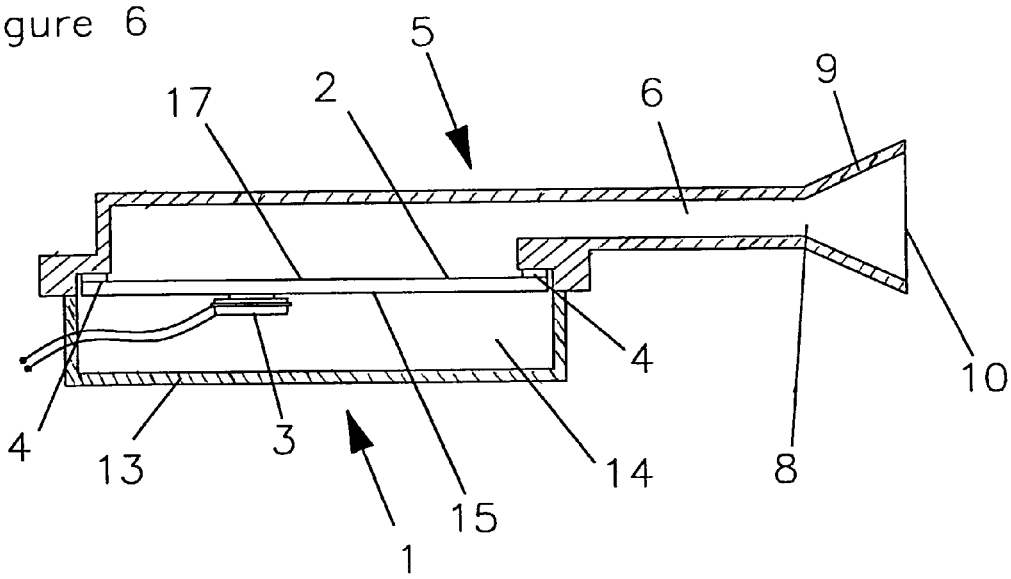
FIG. 6 is a cross-sectional side view of a fifth embodiment of loudspeaker of the invention.

The loudspeaker of FIG. 6 is similar to that of FIG. 5, but in this case the acoustic radiation from the side 15 of the panel facing away from the duct is contained within a cavity 14 defined by an enclosure 13 fixed to or integral with the housing 5 to prevent radiation from the side 15 of the panel 2 from reaching the ambient surroundings.

Figure 7:
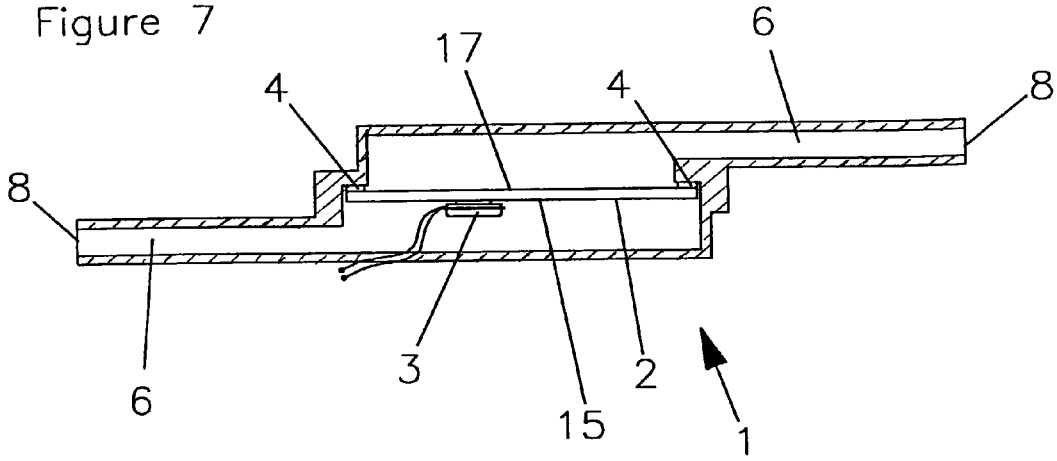
FIG. 7 is a cross-sectional side view of a sixth embodiment of loudspeaker of the invention.

The loudspeaker of FIG. 7 is similar to that of FIG. 4 and in this case the housing 5 defines an opposed pair of parallel sided ducts 6, one being associated with each face or side 15 of the panel 2, the ducts extending in opposite directions towards their open ends 8.

Figure 8:
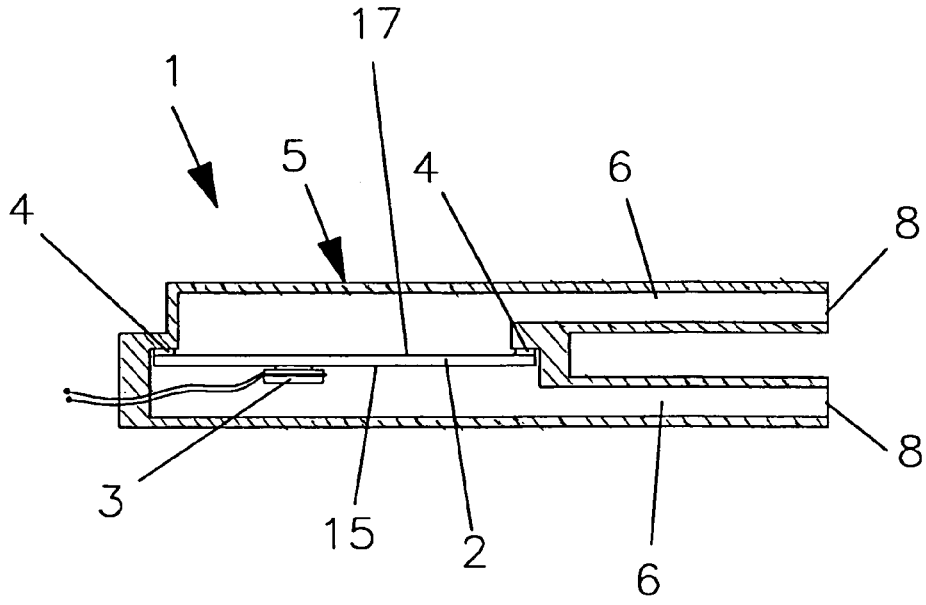
FIG. 8 is a cross-sectional side view of a seventh embodiment of loudspeaker of the invention.

FIG. 8 is a modification of the loudspeaker of FIG. 7 and in which the two ducts 6 each associated with one face of the panel 2 extend in the same direction and in spaced relation.

Figure 9:
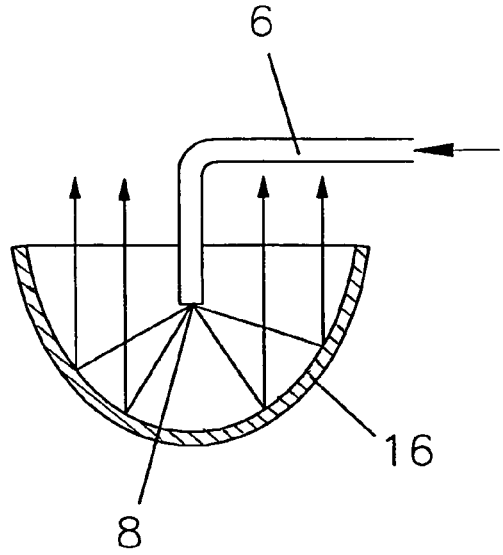
FIG. 9 is a detail of a modification.

FIG. 9 shows that the termination 8 of a duct 6 of a loudspeaker as described above may be modified by placing an acoustic reflector 16 adjacent to the duct termination to focus and direct the sound in the direction shown by the arrows. Thus the reflector is in the form of a parabolic reflector.

FIGS. 10*a* and 10*b* show two forms of a bent or folded duct fed by multiple resonant panels.

In the embodiment of FIG. 10*a*, duct 26 has three angularly disposed rear segments 29*a*, 29*b*, 29*c*. Each rear segment has a resonant panel 22*a*, 22*b*, 22*c*, respectively. The rear of the duct is closed at 27, and the combined acoustic output of panels 22*a*, 22*b*, 22*c* is emitted through duct opening or termination 28.

In the embodiment of FIG. 10*b*, duct 36 has ten angularly disposed rear segments which effectively form a generally curved rear duct section. Each of the ten rear segments has a resonant panel 32*a*–32*j*. The rear of the duct is closed at 37, and the combined acoustic output of panels 32*a*–32*j* is emitted through duct opening or termination 38.

Figure 11:
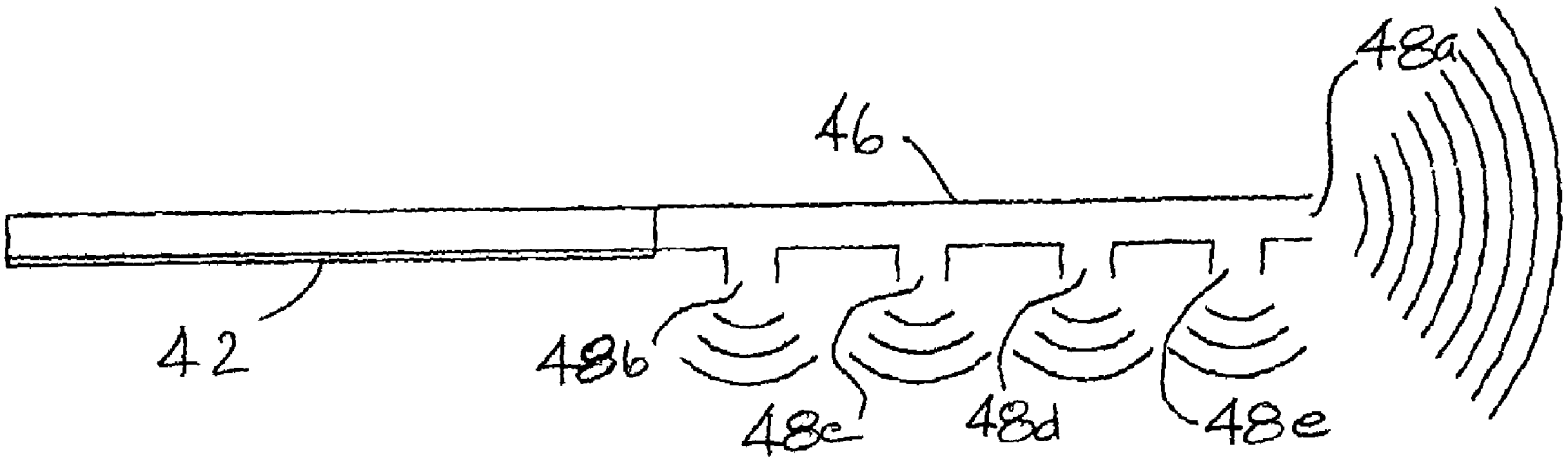
FIG. 11 is a schematic side view of a tenth embodiment of loudspeaker of the invention.

FIG. 11 shows an embodiment having a straight duct 46 with multiple outlets or terminations for the acoustic energy emanating from resonant panel 42. Outlet 48*a* is located at the very end of duct 46, while a plurality of ports 48*b*–48*e* are located along duct 46 and direct sound in a direction perpendicular to the output of outlet 48.

Figure 12A:
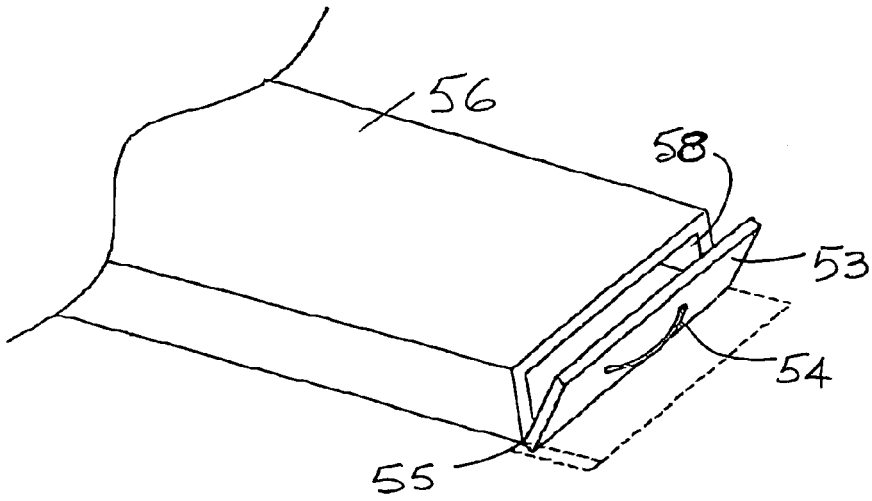
FIG. 12*a* is a perspective view showing one form of attenuator for a duct termination.
Figure 12B:
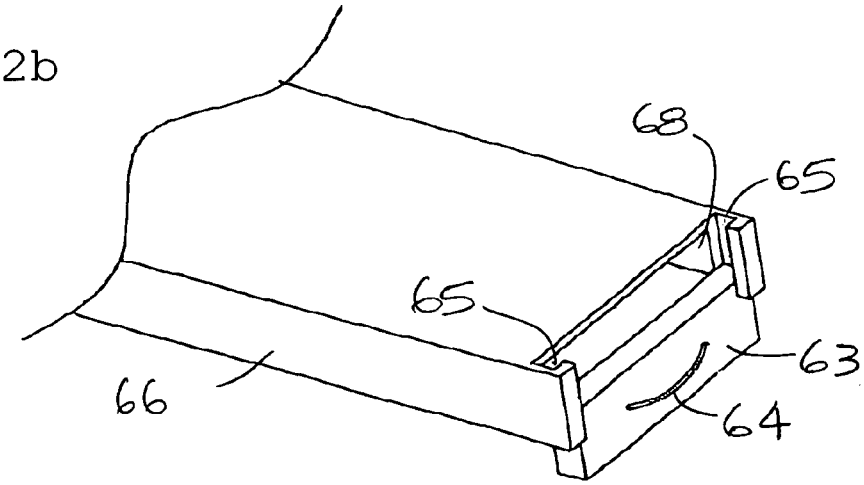
FIG. 12*b* is a perspective view showing another form of attenuator for a duct termination.

FIGS. 12*a* and 12*b* show two forms of loudness control devices located at the outlet or termination of the duct.

In the embodiment of FIG. 12*a*, an attenuator panel 53 having a handle 54 is hinged to duct 56 at one edge 55 of duct termination 58 to control the acoustic energy emanating from duct termination 58.

In the embodiment of FIG. 12*b*, an attenuator panel 63 having a handle 64 is slidably retained on duct 66 in tracks 65 at the opposite sides of duct termination 68 to control the acoustic energy emanating from duct termination 68.

INDUSTRIAL APPLICABILITY

The present invention thus provides a simple loudspeaker mechanism for ducting sound to remote location.

The invention claimed is:

1. A loudspeaker comprising a phase uncorrelated diffuse sound source and a duct or wave guide coupled to the sound source to direct acoustic energy from the source, the duct or wave guide having a section of substantially uniform cross-section extending from and beyond the vicinity of the sound source and having a termination positioned remotely from the sound source, wherein the sound source comprises a bending wave mode acoustic radiator panel.

2. A loudspeaker according to claim 1, comprising a transducer fixed to the panel to excite resonant bending waves therein, wherein the panel has axes and the resonant bending wave modes associated with each of the axes of the panel is arranged to be interleaved in frequency, and the transducer location is chosen preferentially to couple to the resonant bending wave modes.

3. A loudspeaker according to claim 2, wherein the duct is shaped as a narrow slot in cross-section.

4. A loudspeaker according to claim 3, wherein the duct is terminated by a horn section.

5. A loudspeaker according to claim 1, wherein the panel is located in the duct to couple acoustic radiation from both sides of the panel.

6. A loudspeaker according to claim 1, comprising an acoustic reflector coupled to the duct and to the sound source to direct acoustic radiation into the duct.

7. A loudspeaker according to claim 1, wherein the duct has a plurality of terminations.

8. A loudspeaker according to claim 1, comprising a plurality of the panels coupled to the duct.

9. A loudspeaker according to claim 1, wherein the duct is folded.

10. A loudspeaker according to claim 1, comprising an attenuator controlling sound output from a duct termination.

11. A loudspeaker according to claim 1, comprising means subdividing the duct into a plurality of wave guides extending along the duct.

12. A loudspeaker according to claim 11, wherein the duct is subdivided in two directions.

13. A loudspeaker according to claim 1, comprising an acoustic reflector disposed to direct the acoustic output from a duct termination.

14. A loudspeaker according to claim 1, comprising enclosure means enclosing one face of the panel.

15. A loudspeaker according to claim 1, wherein the plane of the panel is parallel to the axis of the duct.

16. A loudspeaker according to claim 1, wherein the duct is shaped as a narrow slot in cross-section.

17. A loudspeaker according to claim 16, wherein the duct is terminated by a horn section.

18. A loudspeaker according to claim 1, wherein the duct is terminated by a horn section.

19. A loudspeaker according to claim 1, comprising an acoustic reflector coupled to the duct and to the sound source to direct acoustic radiation into the duct.

20. A loudspeaker according to claim 1, wherein the duct has a plurality of terminations.

21. A loudspeaker according to claim 1, wherein the duct is folded.

22. A loudspeaker according to claim 1, comprising an attenuator controlling sound output from a duct termination.

23. A loudspeaker according to claim 1, comprising means subdividing the duct into a plurality of wave guides extending along the duct.

24. A loudspeaker according to claim 23, wherein the duct is subdivided in two directions.

25. A loudspeaker according to claim 1, comprising an acoustic reflector disposed to direct the acoustic output from a duct termination.

26. A loudspeaker according to claim 1, comprising enclosure means enclosing one face of the panel.

27. A loudspeaker according to claim 1, wherein the plane of the panel is parallel to the axis of the duct.

* * * * *